US009603761B2

(12) United States Patent
Fukunaga et al.

(10) Patent No.: US 9,603,761 B2
(45) Date of Patent: Mar. 28, 2017

(54) WALKING ASSIST APPARATUS

(71) Applicant: Murata Manufacturing Co., Ltd., Nagaokakyo-shi, Kyoto-fu (JP)

(72) Inventors: Shigeki Fukunaga, Nagaokakyo (JP); Arata Suzuki, Nagaokakyo (JP); Kenichi Shirato, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 658 days.

(21) Appl. No.: 13/949,260

(22) Filed: Jul. 24, 2013

(65) Prior Publication Data

US 2013/0306120 A1 Nov. 21, 2013

Related U.S. Application Data

(63) Continuation of application No. PCT/JP2011/077806, filed on Dec. 1, 2011.

(30) Foreign Application Priority Data

Feb. 23, 2011 (JP) ..... 2011-036637
Sep. 27, 2011 (JP) ..... 2011-210804

(51) Int. Cl.
*A61G 5/00* (2006.01)
*A61G 5/02* (2006.01)
*A61H 3/04* (2006.01)

(52) U.S. Cl.
CPC ..... *A61G 5/022* (2013.01); *A61G 5/024* (2013.01); *A61H 3/04* (2013.01); *A61G 2203/42* (2013.01);
(Continued)

(58) Field of Classification Search
CPC .... A61G 5/022; A61G 5/024; A61G 2203/42; A61H 3/04; A61H 3/06;
(Continued)

(56) References Cited

U.S. PATENT DOCUMENTS 4,280,578 A * 7/1981 Perkins ..... A61H 3/04 180/19.3
8,380,379 B2 * 2/2013 Song ..... B60L 15/20 180/19.2
(Continued)

FOREIGN PATENT DOCUMENTS

CN 101443628 A 5/2009
DE 10 2008 029 564 A1 12/2009
(Continued)

OTHER PUBLICATIONS

Official Communication issued in corresponding European Patent Application No. 11859443.1, mailed on Jan. 29, 2015.
(Continued)

*Primary Examiner* — Tony Winner
*Assistant Examiner* — Michael Stabley
(74) *Attorney, Agent, or Firm* — Keating & Bennett, LLP

(57) ABSTRACT

A walking assist apparatus includes a pair of wheels, at least one first driving unit that drives the pair of wheels, a main body that rotatably supports the pair of wheels, and a grip that is disposed at one end of the main body to be able to be gripped. The walking assist apparatus includes a sensor unit configured to detect an angular change in an inclination angle of the main body in a pitch direction, and a first control unit configured and programmed to control an operation of the at least one first driving unit based on an output of the sensor unit such that the angular change of the main body is zero.

16 Claims, 11 Drawing Sheets

(52) U.S. Cl.
CPC ..... *A61H 2003/043* (2013.01); *A61H 2201/0173* (2013.01); *A61H 2201/5007* (2013.01); *A61H 2201/5069* (2013.01)

(58) Field of Classification Search
CPC ..... A61H 2003/043; A61H 2003/046; A61H 2201/0173; A61H 2201/5007; A61H 2201/5069
See application file for complete search history.

(56) References Cited

U.S. PATENT DOCUMENTS

| | | | | |
|---|---|---|---|---|
| 8,418,705 | B2 * | 4/2013 | Ota | A61H 3/04 135/71 |
| 8,752,658 | B2 * | 6/2014 | Kurek | A61H 3/04 180/19.1 |
| 9,089,460 | B2 * | 7/2015 | Shirato | A61H 3/04 |
| 2003/0010546 | A1 * | 1/2003 | Roberts | A61H 3/04 180/65.1 |
| 2007/0073425 | A1 | 3/2007 | Nakashima et al. | |
| 2009/0045021 | A1 * | 2/2009 | Einbinder | A61H 3/04 188/2 D |
| 2009/0138232 | A1 | 5/2009 | Fuwa et al. | |
| 2010/0193264 | A1 * | 8/2010 | Kurek | A61H 3/04 180/19.1 |
| 2012/0029696 | A1 * | 2/2012 | Ota | A61H 3/04 700/250 |
| 2012/0173088 | A1 * | 7/2012 | Kobashi | B60B 3/048 701/49 |
| 2015/0183482 | A1 * | 7/2015 | Kubo | A61H 3/04 180/209 |

FOREIGN PATENT DOCUMENTS

| | | | |
|---|---|---|---|
| DE | 20 2010 001 916 | U1 | 5/2010 |
| FR | 2 796 548 | A1 | 1/2001 |
| JP | 2898969 | B1 | 6/1999 |
| JP | 2005-245637 | A | 9/2005 |
| JP | 2007-69688 | A | 3/2007 |
| JP | 2009-183407 | A | 8/2009 |
| JP | 2009-247611 | A | 10/2009 |
| JP | 2010-195129 | A | 9/2010 |
| JP | 2011-019571 | A | 2/2011 |
| KR | 10-2002-0010152 | A | 2/2002 |
| KR | 10-2008-0073280 | A | 8/2008 |
| WO | 00/75001 | A1 | 12/2000 |

OTHER PUBLICATIONS

Official Communication issued in corresponding Korean Patent Application No. 10-2013-7021487, mailed on Apr. 29, 2016.
Official Communication issued in International Patent Application No. PCT/JP2011/077806, mailed on Mar. 13, 2012.
Official Communication issued in corresponding Chinese Patent Application No. 201180067913.X, mailed on Aug. 19, 2014.

* cited by examiner

WALKING ASSIST APPARATUS

BACKGROUND OF THE INVENTION

1. Field of the Invention

The present invention relates to a walking assist apparatus capable of preventing falling in a pitch direction.

2. Description of the Related Art

Conventionally, many walking assist apparatuses have been developed as devices that assist the elderly and disabled in walking. Conventional walking assist apparatuses often have four or eight wheels to prevent the elderly and disabled from falling during walking. Such walking assist apparatuses have a carrier bag or the like to lower the center of gravity thereof, so as to enhance stability during walking.

To assist the elderly and disabled in walking, it is preferable that wheels be rotated by an electric motor or the like. For example, Japanese Patent No. 2898969 discloses a walking assist apparatus that estimates a moving state of a person assisted in walking (hereinafter referred to as "user") on the basis of an external force detected by a sensor, and drives itself appropriately in accordance with the moving state of the user.

The walking assist apparatus disclosed in Japanese Patent No. 2898969 requires a sensor that detects an external force. Therefore, to allow the walking assist apparatus to drive itself, the user has to always consciously apply a certain level of external force. Moreover, since the external force needs to be applied to a place where there is the sensor, the walking assist apparatus is difficult to deal with for an elderly or disabled person who is the user.

The elderly and disabled (users) tend to fall more often than people without disabilities. To prevent front or rear wheels from floating, conventional walking assist apparatuses have a main body that weighs over a certain amount, wheels that are spaced apart over a certain distance, or the like. As a result, since such walking assist apparatuses have a base area larger than a certain size, it may not be allowed to bring them on public transport, such as trains, depending on the base area.

SUMMARY OF THE INVENTION

In view of the circumstances described above, preferred embodiments of the present invention provide a walking assist apparatus that includes a small base area, and is capable of assisting an elderly or disabled person (user) in walking, and preventing the user from falling.

A walking assist apparatus according to a preferred embodiment of the present invention includes a pair of wheels, at least one first driving unit that drives the pair of wheels, a main body that rotatably supports the pair of wheels, and a grip that is disposed at one end of the main body to be able to be gripped. The walking assist apparatus includes a sensor unit configured to detect an angular change in an inclination angle of the main body in a pitch direction; and a first control unit configured and programmed to control an operation of the at least one first driving unit, on the basis of an output of the sensor unit, such that the angular change of the main body is zero.

In the configuration described above, on the basis of an output of the sensor unit that detects an angular change in an inclination angle of the main body in the pitch direction, the first control unit is programmed to control an operation of the at least one first driving unit such that the angular change of the main body is zero. Therefore, the inclination angle of the main body in the pitch direction can be controlled to converge to a balanced angle at which the main body can be kept balanced and does not fall over. Thus, without requiring an elderly or disabled person (user) to particularly consciously apply an external force, the walking assist apparatus can stably assist the elderly or disabled person (user) in walking.

In the walking assist apparatus according to a preferred embodiment of the present invention, it is preferable that the sensor unit include at least one of an angular velocity sensor, an inclination sensor, and an angular acceleration sensor.

In the configuration described above, where the sensor unit includes at least one of an angular velocity sensor, an inclination sensor, and an angular acceleration sensor, it is possible to reliably detect an angular change in inclination angle of the main body in the pitch direction.

In the walking assist apparatus according to a preferred embodiment of the present invention, it is preferable that the main body include a support unit connected at one end thereof to the main body so as to be pivotable in the pitch direction, and that the other end of the support unit be provided with one or a pair of rotatable auxiliary wheels.

In the configuration described above, the main body includes a support unit connected at one end thereof to the main body so as to be pivotable in the pitch direction, and the other end of the support unit is provided with one or a pair of rotatable auxiliary wheels. Thus, even when the elderly or disabled person (user) leans his or her body weight on the grip, the one or pair of rotatable auxiliary wheels can reduce inclination of the main body, so that the walking assist apparatus can safely assist the elderly or disabled person (user) in walking.

In the walking assist apparatus according to a preferred embodiment of the present invention, it is preferable that the grip be turnable in a yaw direction of the main body. In the configuration described above, the grip is turnable in the yaw direction of the main body. This makes it possible, as viewed from the elderly or disabled person (user), to select either positioning the one or pair of rotatable auxiliary wheels between the pair of wheels of the main body and the user, or positioning the pair of wheels of the main body between the one or pair of rotatable auxiliary wheels and the user.

The walking assist apparatus according to a preferred embodiment of the present invention preferably further includes a second driving unit configured to rotate a connection portion of the support unit or the one or pair of auxiliary wheels, and a second control unit configured and programmed to control the second driving unit. It is preferable that the second control unit receives designation of a target angle for an angle between the support unit and the main body; and that the second control unit control an operation of the second driving unit, on the basis of an output of the sensor unit, such that the angle between the support unit and the main body is equal to the target angle.

In the configuration described above, the second control unit receives designation of a target angle for an angle between the support unit and the main body, and the second control unit controls an operation of the second driving unit, on the basis of an output of the sensor unit, such that the angle between the support unit and the main body is equal to the target angle. Thus, it is possible to perform control such that the angle between the support unit including the one or pair of auxiliary wheels and the main body is equal to the target angle, so that the main body can be prevented from falling.

In the walking assist apparatus according to a preferred embodiment of the present invention, it is preferable that the second driving unit be provided in the connection portion of the support unit; and that the second control unit determine whether a change in output of the sensor unit exceeds a predetermined threshold and that, if it is determined that the change in output of the sensor unit exceeds the predetermined threshold, the second control unit perform delay control to reduce a change in angle between the support unit and the main body.

In the configuration described above, the second control unit determines whether a change in output of the sensor unit exceeds a predetermined threshold. If it is determined that the change in output of the sensor unit exceeds the predetermined threshold, the second control unit performs delay control to reduce a change in angle between the support unit and the main body. Therefore, even if a large external force is suddenly applied and the user almost falls, the behavior of the main body does not change significantly. It is thus possible to reduce the risk of falling of the elderly or disabled person (user).

In the walking assist apparatus according to a preferred embodiment of the present invention, it is preferable that the second driving unit be provided in the connection portion of the support unit; and that the second control unit determine whether a change in output of the sensor unit or a change in output of an encoder of the second driving unit exceeds a predetermined threshold and that, if it is determined that the change in output of the sensor unit or the change in output of the encoder of the second driving unit does not exceed the predetermined threshold, the second control unit do not control the second driving unit.

In the configuration described above, the second control unit determines whether a change in output of the sensor unit or a change in output of an encoder of the second driving unit exceeds a predetermined threshold. If it is determined that the change in output of the sensor unit or the change in output of the encoder of the second driving unit does not exceed the predetermined threshold, the second control unit does not control the second driving unit. This allows the one or a pair of auxiliary wheels to serve as a brake, and to support the user like a stick does.

The walking assist apparatus according to a preferred embodiment of the present invention preferably further includes a first restraining mechanism configured to restrain pivoting of the support unit, and a detector arranged to detect whether there is an input from a user to the grip. It is preferable that, if the detector detects that there is no input to the grip, the first restraining mechanism stop pivoting of the support unit.

In the configuration described above, the walking assist apparatus further includes a first restraining mechanism configured to restrain pivoting of the support unit, and a detector arranged to detect whether there is an input from a user to the grip. If the detector detects that there is no input to the grip, the first restraining mechanism stops pivoting of the support unit. Thus, when the detector detects that the user does not touch the grip, the support unit does not pivot and can maintain the position of the walking assist apparatus. It is thus possible to reduce power consumption.

In the walking assist apparatus according to a preferred embodiment of the present invention, it is preferable that, if the detector determines that there is no change in output of the sensor unit for more than a certain period of time, the detector detects that there is no input to the grip.

In the configuration described above, if the detector determines that there is no change in output of the sensor unit for more than a certain period of time, the detector detects that there is no input to the grip. In this case, the support unit does not pivot, and can maintain the position of the walking assist apparatus. It is thus possible to reduce power consumption.

In the walking assist apparatus according to a preferred embodiment of the present invention, it is preferable that the detector include a contact sensor provided in the grip.

In the configuration described above, where a contact sensor provided in the grip is used as the detector, it is possible to detect whether the user has touched the grip.

In the walking assist apparatus according to a preferred embodiment of the present invention, it is preferable that, when the first restraining mechanism stops pivoting of the support unit, the first control unit do not control the first driving unit.

In the configuration described above, when the first restraining mechanism stops pivoting of the support unit, the first control unit does not control the first driving unit. Since the position of the walking assist apparatus can be maintained by the support unit alone, it is possible to reduce the amount of power required to control the first driving unit.

The walking assist apparatus according to a preferred embodiment of the present invention preferably further includes a second restraining mechanism configured to stop rotation of at least one wheel of the pair of wheels when the first restraining mechanism stops pivoting of the support unit.

In the configuration described above, the walking assist apparatus further includes a second restraining mechanism configured to stop rotation of at least one wheel of the pair of wheels when the first restraining mechanism stops pivoting of the support unit. Thus, since at least one of the wheels can be forcibly locked, the support unit can easily maintain the position of the main body.

In the configuration described above, on the basis of an output of the sensor unit configured to detect an angular change in inclination angle of the main body in the pitch direction, the operation of at least one first driving unit is controlled such that the angular change of the main body is zero. Therefore, the inclination angle of the main body in the pitch direction can be controlled to converge to a balanced angle at which the main body can be kept balanced and does not fall over. Thus, without requiring the elderly or disabled person (user) to particularly consciously apply an external force, the walking assist apparatus can stably assist the elderly or disabled person (user) in walking.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

A walking assist apparatus according to preferred embodiments of the present invention will now be specifically described on the basis of the drawings.

Figure 1:
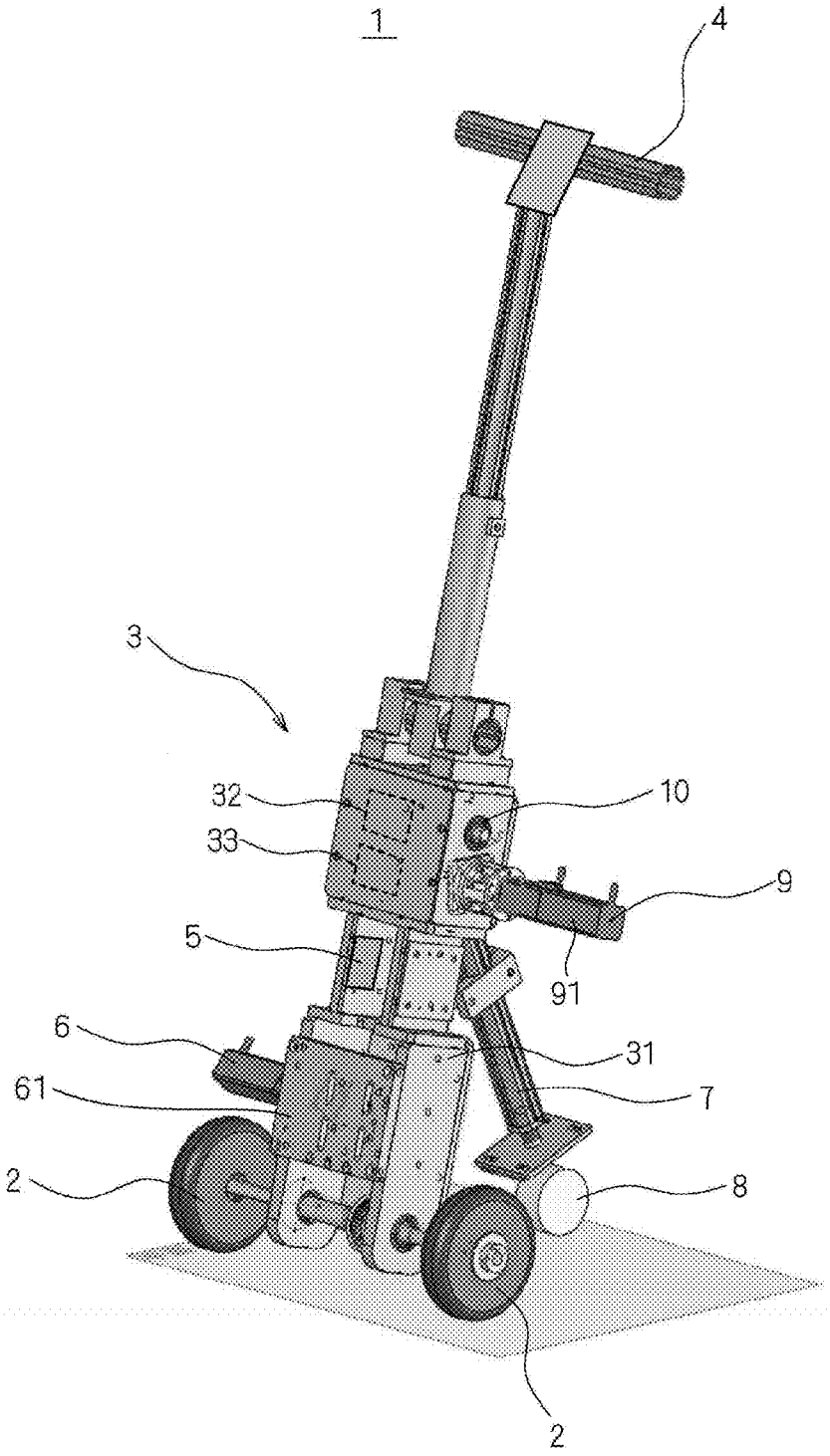
FIG. 1 is a perspective view illustrating a configuration of a walking assist apparatus according to a preferred embodiment of the present invention.

FIG. 1 is a perspective view illustrating a configuration of a walking assist apparatus according to a preferred embodiment of the present invention. A walking assist apparatus 1 according to the present preferred embodiment includes a pair of wheels 2 rotatably supported on a main body 3, and a grip 4 disposed at one end of the main body 3 opposite to the side where the pair of wheels 2 is supported. An elderly or disabled person (user) holds the grip 4 while walking.

Figure 2:
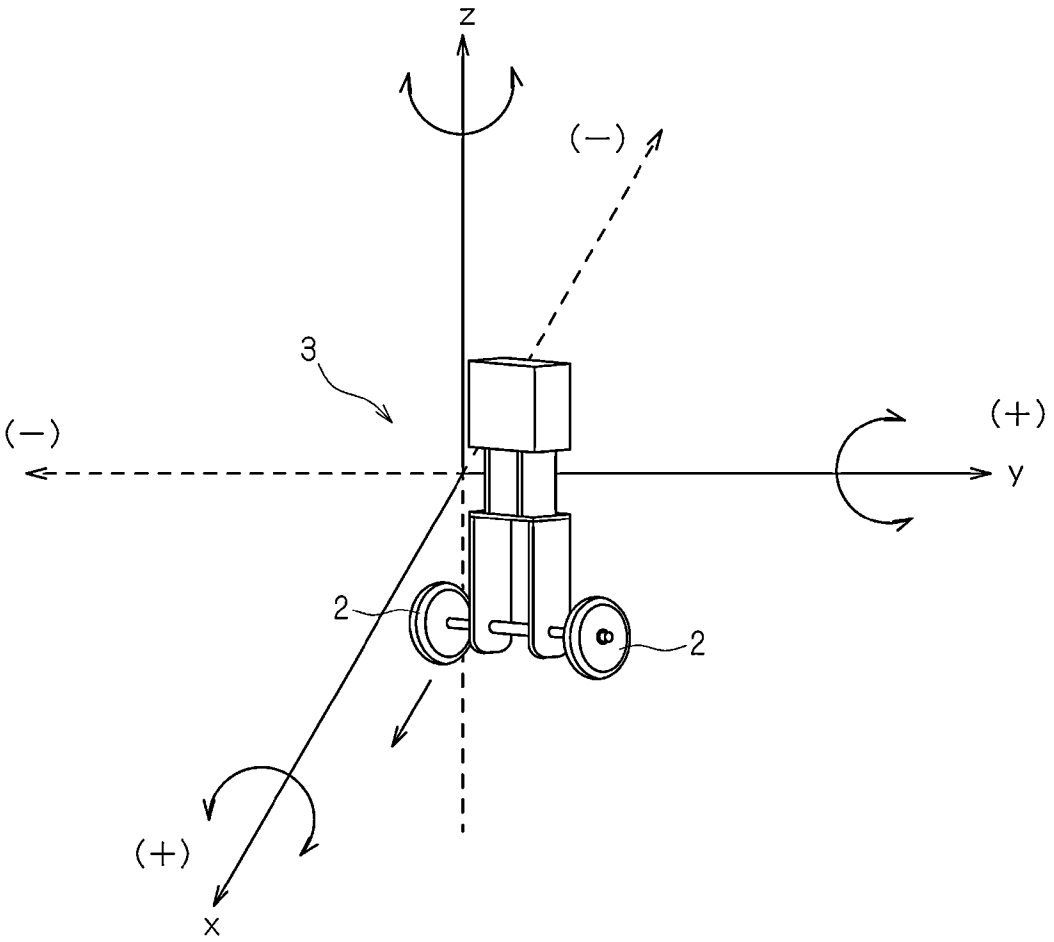
FIG. 2 schematically illustrates a pitch direction, a roll direction, and a yaw direction.

A pitch direction will now be defined. FIG. 2 schematically illustrates a pitch direction, a roll direction, and a yaw direction. As illustrated in FIG. 2, when the walking assist apparatus 1 moves forward in the positive (+) direction of the x-axis or moves backward in the negative (−) direction of the x-axis in the x-y plane, the rotation direction about the y-axis is a pitch direction. If the walking assist apparatus 1 turns counterclockwise as viewed from the positive direction of the y-axis, the main body 3 is inclined forward. If the walking assist apparatus 1 turns clockwise as viewed from the positive direction of the y-axis, the main body 3 is inclined backward. The rotation direction about the x-axis is a roll direction which is a rotation direction in which the main body 3 swings to the right and left. The rotation direction about the z-axis is a yaw direction which is a rotation direction in which the orientation of the pair of wheels 2 is inclined from the x-axis direction.

As illustrated in FIG. 1, the main body 3 includes a pitch gyro sensor (sensor unit) 5 that detects a pitch angular velocity which is the angular velocity of an inclination angle in the pitch direction, a pitch motor (first driving unit) 6 that operates in synchronization with rotation of the pair of wheels 2 to rotate the pair of wheels 2, and a pitch encoder (pitch rotation sensor) 61 that detects a rotational position (angle) or rotational velocity of the pitch motor 6. The pitch gyro sensor 5 is attached to the main body 3, with its detection shaft (not shown) that detects a pitch angular velocity in or substantially in the right and left direction. Note that "substantially in the right and left direction" indicates that there may be some upward or downward angular deviation from the exact right and left direction. The main body 3 and the pair of wheels 2 are connected to each other by a frame 31 that rotatably supports the pair of wheels 2. The rotation of the pitch motor 6 is transmitted through a belt (not shown) of the main body 3 to the pair of wheels 2. The frame 31 is preferably part of the main body 3. The pitch gyro sensor 5 is not limited to a gyro sensor and may be of any type, as long as it is capable of detecting a pitch angular velocity.

Figure 3:
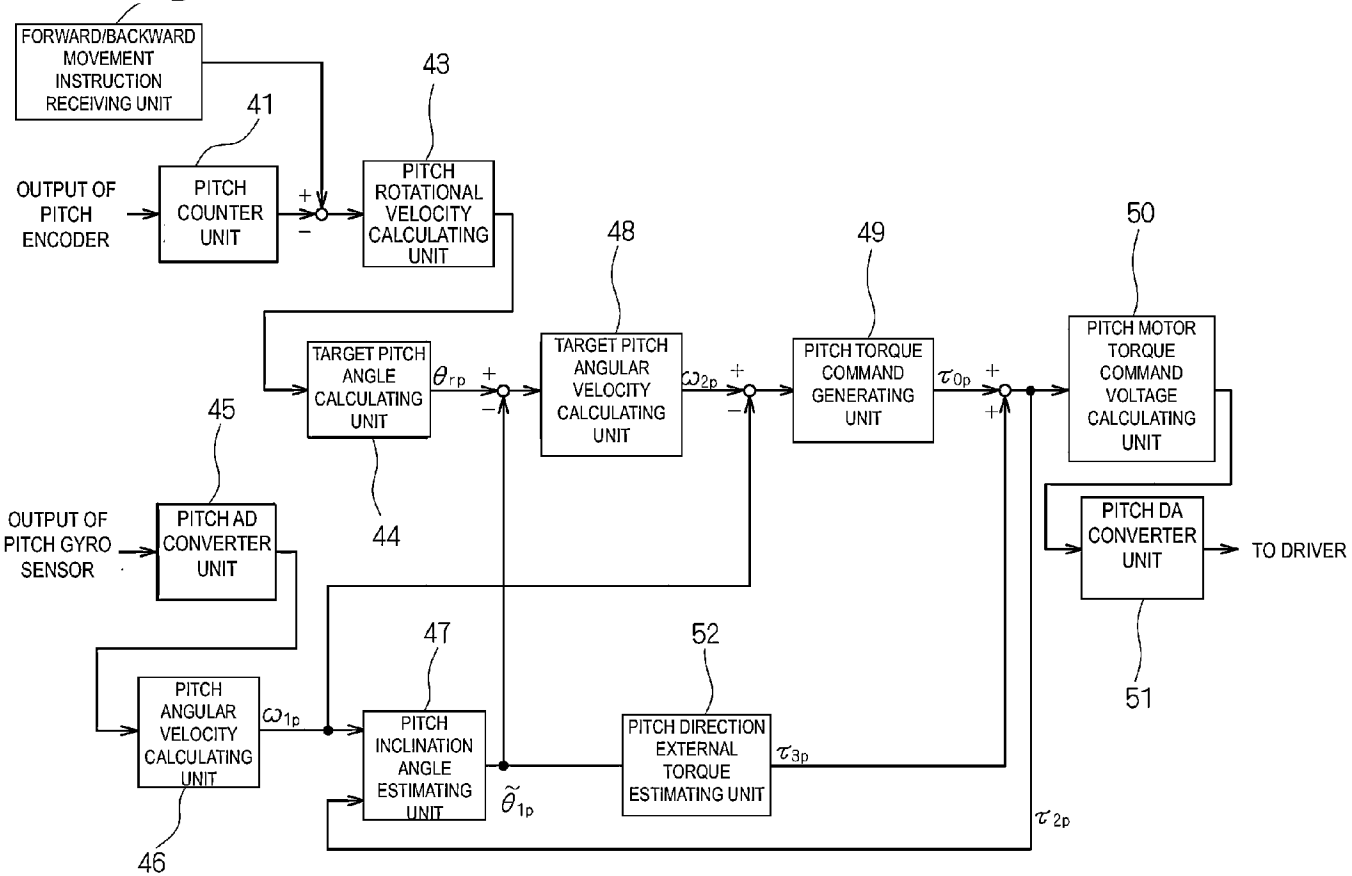
FIG. 3 is a control block diagram illustrating a control operation that prevents the walking assist apparatus from falling in the pitch direction.

The main body 3 is equipped with a control board (first control unit) 32 that controls the operation (rotation) of the pitch motor 6, and a battery 33. The control board 32 includes a driver that drives the pitch motor 6 to rotate, an A/D converter, a D/A converter, a counter, and a controller mounted thereon. The controller is, for example, a microprocessor, a CPU, or an LSI. The walking assist apparatus 1 performs control to achieve a balance in the pitch direction by using a reaction torque associated with rotation of the pair of wheels 2. FIG. 3 is a control block diagram illustrating a control operation to prevent the walking assist apparatus 1 from falling in the pitch direction.

As illustrated in FIG. 3, a pitch counter unit 41 counts the number of pulses of an output pulse signal from the pitch encoder 61. A forward/backward movement instruction receiving unit 42 receives an instruction for forward or backward movement of the pair of wheels 2 in the form of a pulse signal of a rotational velocity or a rotational angle. When an instruction for forward or backward movement is received in the form of a pulse signal of a rotational angle, a pitch rotational velocity calculating unit 43 subtracts the number of pulses counted by the pitch counter unit 41 from the number of pulses of the pulse signal representing the instruction for forward or backward movement, converts the resulting number of pulses into a rotational angle (deviation), and differentiates the resulting rotational angle to determine the rotational velocity of the pitch motor 6. A low-pass filter may be provided for noise reduction, for example.

In response to the rotational velocity of the pitch motor 6 determined by the pitch rotational velocity calculating unit 43, the target pitch angle calculating unit 44 multiplies the rotational velocity of the pitch motor 6 by a proportionality factor to determine a target pitch angle $\theta_{rp}$ such that the pair of wheels 2 is oriented forward when the pitch motor 6 rotates to move the pair of wheels 2 forward, and that the pair of wheels 2 is oriented backward when the pitch motor 6 rotates to move the pair of wheels 2 backward. Thus, it is possible to correct inclination in the pitch direction while ensuring the rotational velocity for movement required by the instruction.

A pitch AD converter unit 45 AD-converts a pitch angular velocity output of the pitch gyro sensor 5 and acquires the resulting pitch angular velocity output. A pitch angular velocity calculating unit 46 multiples the acquired pitch angular velocity output by a conversion factor to determine a pitch angular velocity $\omega_{1p}$.

In response to the pitch angular velocity $\omega_{1p}$ and a pitch torque command $\tau_{2p}$ (described below), the pitch inclination angle estimating unit 47 derives Equation 18 (described below) and solves Equation 18 to estimate a pitch inclination angle from equations of motion of a system including the main body 3 and the pair of wheels 2 in an inclination angle direction (pitch direction). An estimate of the pitch inclination angle is determined preferably by adding on a first-order lag element in series to provide an appropriate estimated velocity to stabilize a loop. Specifically, a first-order lag element, such as 1/(0.1 S+1), is added in series to the pitch inclination angle estimated using Equation 18. The first-order lag element is not limited to this, and any first-order lag element can be added, as long as an appropriate estimated velocity can be realized.

A pitch direction external torque estimating unit 52 multiplies the estimate of the pitch inclination angle by a conversion factor to determine an estimate of a pitch direction external torque acting on the main body 3, and produces a pitch correction torque $\tau_{3p}$ corresponding to the determined estimate of the pitch direction external torque.

A target pitch angular velocity calculating unit 48 multiplies, by a proportional gain, a pitch angular deviation obtained by subtracting the estimate of the pitch inclination angle from the target pitch angle $\theta_{rp}$ so as to determine a target pitch angular velocity $\omega_{2p}$. A pitch torque command generating unit 49 performs, for example, PI control on a deviation between the target pitch angular velocity $\omega_{2p}$ and the pitch angular velocity $\omega_{1p}$ to generate a pitch torque command $\tau_{0p}$. A pitch motor torque command voltage calculating unit 50 multiplies, by a conversion factor, the pitch torque command $\tau_{2p}$ obtained by adding the pitch correction torque $\tau_{3p}$ to the pitch torque command $\tau_{0p}$ so as to determine a command voltage. Finally, a pitch DA converter unit 51 outputs the command voltage to the driver, which controls the operation of the pitch motor 6.

Figure 4:
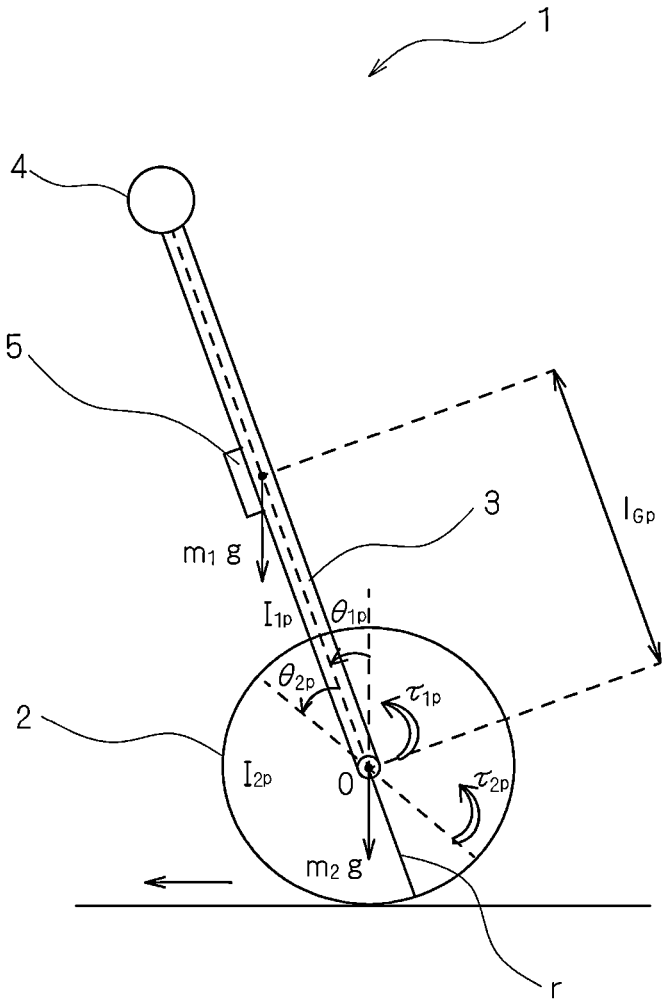
FIG. 4 is a lateral schematic view of a model of the walking assist apparatus.

A method for deriving a calculation equation (Equation 18) used to estimate a pitch inclination angle will now be described. FIG. 4 is a lateral schematic view of a model of the walking assist apparatus 1. FIG. 4 schematically illustrates only the pair of wheels 2, the main body 3, and the pitch gyro sensor 5 attached to the main body 3. The direction of a leftward arrow in FIG. 4 is the direction of forward movement. The main body 3 is inclined forward in FIG. 4. First, equations of motions are derived from Lagrange's equations. Overall kinetic energy T and potential energy U of the main body 3 and the pair of wheels 2 are as follows:

Numerical Expression 1

$$T = \frac{1}{2} I_{1p}\dot{\theta}_{1p}^2 + \frac{1}{2} I_{2p}(\dot{\theta}_{1p} + \dot{\theta}_{2p})^2 \quad \text{Equation 1}$$

$$U = m_1 l_{Gp} g \cos\theta_{1p} + m_2 r g \quad \text{Equation 2}$$

where $I_{1p}$ is a moment of inertia of the main body about a rotational center O, $\theta_{1p}$ is an inclination angle of the main body with respect to the vertical axis in the pitch direction, $I_{2p}$ is a moment of inertia of the wheels about the rotational center O, $\theta_{2p}$ is a rotational angle of the wheels with respect to the main body, $m_1$ is a mass of the main body, $l_{Gp}$ is a distance between the rotational center O and a position of the center of gravity of the main body, g is a gravitational acceleration, r is a radius of the wheels, and $m_2$ is a mass of an inertia rotor.

The amount of differentiation in the generalized coordinates and a generalized velocity is as follows:

Numerical Expression 2

$$\frac{\partial T}{\partial \dot{\theta}_{1p}} = I_{1p}\dot{\theta}_{1p} + I_{2p}(\dot{\theta}_{1p} + \dot{\theta}_{2p}) \quad \text{Equation 3}$$

-continued $$\frac{\partial T}{\partial \dot{\theta}_{2p}} = I_{2p}(\dot{\theta}_{1p} + \dot{\theta}_{2p}) \quad \text{Equation 4}$$

$$\frac{\partial T}{\partial \theta_{1p}} = 0 \quad \text{Equation 5}$$

$$\frac{\partial T}{\partial \theta_{2p}} = 0 \quad \text{Equation 6}$$

$$\frac{\partial U}{\partial \theta_{1p}} = -m_1 l_{Gp} g \sin\theta_{1p} \quad \text{Equation 7}$$

$$\frac{\partial U}{\partial \theta_{2p}} = 0 \quad \text{Equation 8}$$

Equations 3 to 8 are substituted into Lagrange's equations, Equations 9 and 10:

Numerical Expression 3

$$\frac{d}{dt}\left(\frac{\partial T}{\partial \dot{\theta}_{1p}}\right) - \frac{\partial T}{\partial \theta_{1p}} + \frac{\partial U}{\partial \theta_{1p}} = \tau_{1p} \quad \text{Equation 9}$$

$$\frac{d}{dt}\left(\frac{\partial T}{\partial \dot{\theta}_{2p}}\right) - \frac{\partial T}{\partial \theta_{2p}} + \frac{\partial U}{\partial \theta_{2p}} = \tau_{2p} \quad \text{Equation 10}$$

where $\tau_{1p}$ is a torque about the rotational center O acting on the main body, and $\tau_{2p}$ is a torque acting on the wheels.

As a result, the following Equations 11 and 12 are obtained as equations of motion:

Numerical Expression 4

$$I_{1p}\ddot{\theta}_{1p} + I_{2p}(\ddot{\theta}_{1p} + \ddot{\theta}_{2p}) - m_1 l_{Gp} g \sin\theta_{1p} = \tau_{1p} \quad \text{Equation 11}$$

$$I_{2p}(\ddot{\theta}_{1p} + \ddot{\theta}_{2p}) = \tau_{2p} \quad \text{Equation 12}$$

Equation 13 is obtained by modifying Equation 12:

Numerical Expression 5

$$\ddot{\theta}_{2p} = \frac{\tau_{2p}}{I_{2p}} - \ddot{\theta}_{1p} \quad \text{Equation 13}$$

Equation 14 is obtained by substituting Equation 13 into Equation 11 and approximating sin $\theta_{1p}$ by $\theta_{1p}$. Equation 14 makes a motion of the main body 3 irrelevant to the rotational angle and the angular velocity of the pair of wheels 2:

Numerical Expression 6

$$I_{1p}\ddot{\theta}_{1p} - m_1 l_{Gp} g \theta_{1p} = \tau_{1p} - \tau_{2p} \quad \text{Equation 14}$$

Although the pitch inclination angle can be obtained by integrating the output of the pitch gyro sensor 5, the method for obtaining the pitch inclination angle is not particularly limited to this. For example, by using an equation of motion of the model illustrated in FIG. 4, a pitch inclination angle is estimated from the pitch angular velocity $\omega_{1p}$ and the pitch torque command $\tau_{2p}$. Equation 15 is obtained by modifying the equation of motion, Equation 14:

Numerical Expression 7

$$\theta_{1p} + \frac{\tau_{1p}}{m_1 l_{Gp} g} = \frac{\tau_{2p} + I_{1p}\ddot{\theta}_{1p}}{m_1 l_{Gp} g} \quad \text{Equation 15}$$

The pitch angular velocity $\omega_{1p}$ is expressed by Equation 16:

Numerical Expression 8

$$\ddot{\theta}_{1p} \approx \dot{\omega}_{1p} \quad \text{Equation 16}$$

When a torque $\tau_{1p}$ is produced by an external force in a direction (pitch direction) in which the main body 3 is inclined, an apparent balanced inclination angle $\theta_{0p}$ is given by Equation 17:

Numerical Expression 9

$$\theta_{0p} = -\frac{\tau_{1p}}{m_1 l_{Gp} g} \quad \text{Equation 17}$$

Therefore, a deviation angle (pitch inclination angle) between the apparent balanced inclination angle $\theta_{0p}$ and the current inclination angle $\theta_{1p}$ in the pitch direction can be estimated by solving Equation 18 derived from Equations 15, 16, and 17 described above. To provide an appropriate estimated velocity to stabilize a loop, a first-order lag element may be preferably added on in series. Equation 18 is an exemplary calculation equation for estimating a pitch inclination angle, and the calculation equation for estimating a pitch inclination angle may vary depending on the model used:

Numerical Expression 10

$$\tilde{\theta}_{1p} \equiv \theta_{1p} - \left(-\frac{\tau_{1p}}{m_1 l_{Gp} g}\right) \cong \frac{\tau_{2p} + I_{1p}\dot{\omega}_{1p}}{m_1 l_{Gp} g} \quad \text{Equation 18}$$

where $\tilde{\theta}_{1p}$ is an estimate of the pitch inclination angle.

From the pitch angular velocity $\omega_{1p}$ and the pitch torque command $\tau_{2p}$ generated on the basis of the target pitch angle $\theta_{rp}$, a pitch inclination angle is estimated, which is an angle by which the main body 3 is inclined from a balanced state in the pitch direction. Thus, it is possible to accurately estimate a pitch inclination angle. Since the pitch angular velocity output of the pitch gyro sensor 5 is not subjected to integration, there is no calculation error in target pitch angle caused by accumulation of noise or offsets. It is thus possible to accurately correct inclination from a balanced state in the pitch direction by using a reaction torque associated with rotation of the pair of wheels 2, and prevent falling in the pitch direction.

A pitch direction external torque is compensated for with the deviation angle estimated using Equation 18 (i.e., the estimate of the pitch inclination angle). An estimate of the pitch direction external torque can be expressed by Equation 19 using the deviation angle estimated using Equation 18 (i.e., the estimate of the pitch inclination angle):

Numerical Expression 11

$$\tilde{\tau}_{2p} = m_1 l_{Gp} g \tilde{\theta}_{1p} \quad \text{Equation 19}$$

where $\tilde{\tau}_{2p}$ is an estimate of the pitch direction external torque.

A pitch direction internal torque obtained by subtracting the estimate of the pitch direction external torque from the torque $\tau_{2p}$ acting on the wheels is expressed by Equation 20:

Numerical Expression 12

$$\tau_{2p} = \hat{\tau}_{2p} + \tilde{\tau}_{2p} \quad \text{Equation 20}$$

where $\hat{\tau}_{2p}$ is a pitch direction internal torque.

Since the equation of motion, Equation 14, can be modified to Equation 21 by using Equations 14, 18, 19, and 20, it is possible to compensate for the pitch direction external torque. By using Equation 18 to estimate the pitch inclination angle by which the main body 3 is inclined from a balanced state in the pitch direction, the pitch direction external torque produced by the inclination from the balanced state in the pitch direction can be estimated. It is thus possible to calculate a pitch correction torque corresponding to the estimated pitch direction external torque. Therefore, since the rotation of the pitch motor 6 can be more properly controlled by taking the influence of the pitch direction external torque into account, it is possible to more accurately correct the inclination from a balanced state in the pitch direction and prevent falling in the pitch direction. In particular, even when the response frequencies of an inclination angle loop and an inclination angle velocity loop are low, it is possible to continue the control operation to prevent falling in the pitch direction by compensating for the pitch direction external torque through feedforward control. Stable control can thus be achieved:

Numerical Expression 13

$$I_{1p}\ddot{\theta}_{1p} = -\hat{\tau}_{2p} \quad \text{Equation 21}$$

The corrected pitch torque command is output through the pitch DA converter unit 51 to the driver, which controls the rotation of the pitch motor 6. The rotation of the pitch motor 6 is transmitted to the pair of wheels 2.

Figure 5:
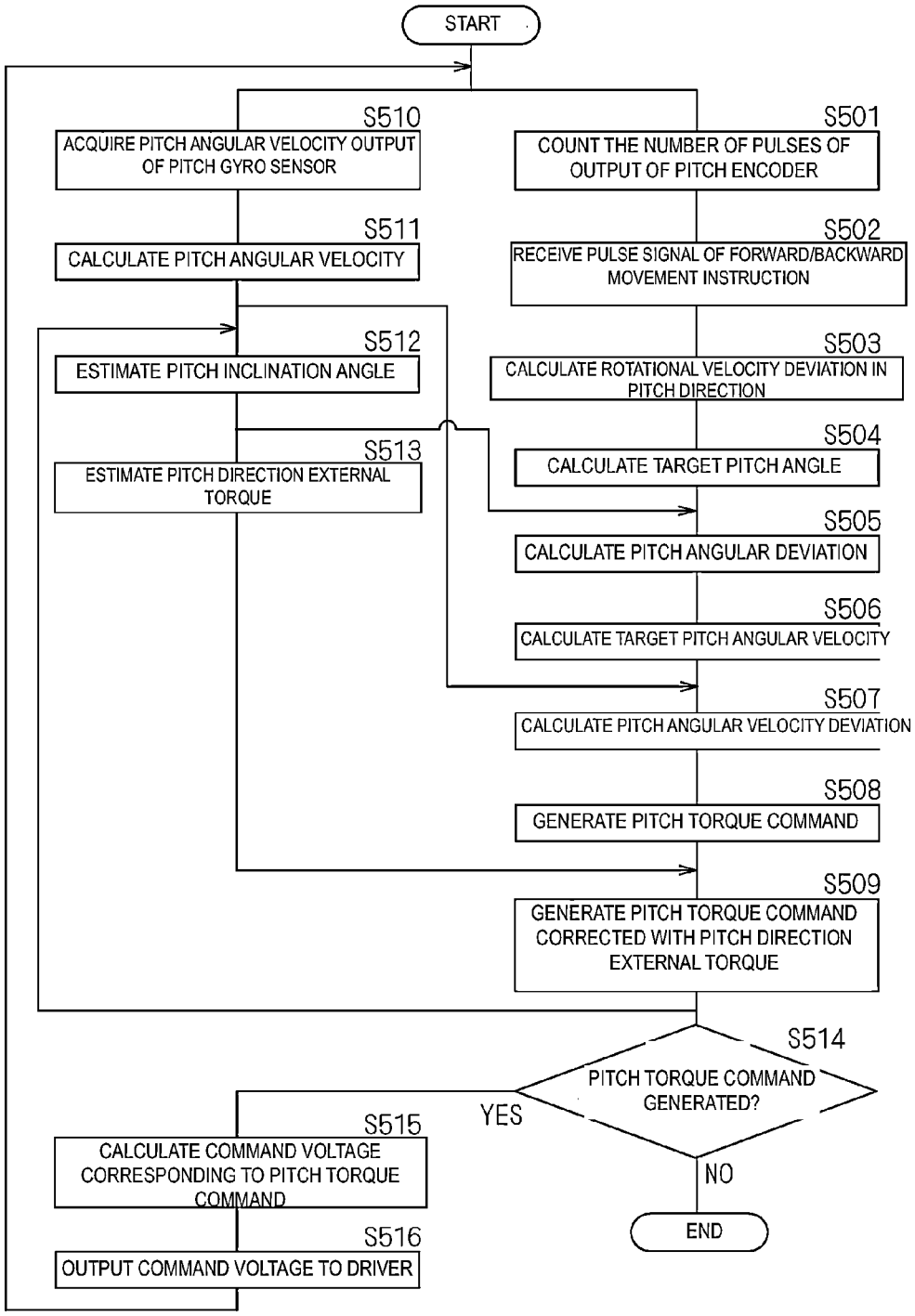
FIG. 5 is a flowchart illustrating a process that prevents falling in the pitch direction, the process being performed by a controller of a control board in the walking assist apparatus according to a preferred embodiment of the present invention.

A control operation to control the operation of the walking assist apparatus 1 including the control blocks illustrated in FIG. 3 will now be described on the basis of a flowchart. FIG. 5 is a flowchart illustrating a process that prevents falling in the pitch direction, the process being performed by the controller of the control board 32 in the walking assist apparatus 1 according to a preferred embodiment of the present invention.

As illustrated in FIG. 5, the controller of the control board 32 counts the number of pulses of an output (pulse signal) of the pitch encoder 61 that detects a rotational position (angle) or rotational velocity of the pitch motor 6 (step S501). The controller receives an instruction for forward (or backward) movement of the pair of wheels 2 in the form of a pulse signal of a rotational velocity (step S502).

The controller calculates a rotational velocity deviation in the pitch direction on the basis of the number of pulses obtained by subtracting the number of pulses of the output (pulse signal) of the pitch encoder 61 from the number of pulses of the pulse signal representing the instruction for forward (or backward) movement (step S503). Specifically, after converting the number of pulses obtained by the subtraction into a rotational angle, the controller differentiates the resulting rotational angle to determine the rotational velocity deviation. On the basis of the rotational velocity deviation in the pitch direction, the controller calculates a target pitch angle which is a target inclination angle in the pitch direction (step S504).

The controller subtracts, from the determined target pitch angle, a pitch inclination angle estimated in step S512 (described below) to determine a pitch angular deviation (step S505), and multiplies the determined pitch angular deviation by a proportional gain to determine the target pitch angular velocity $\omega_{2p}$ (step S506).

The controller calculates a pitch angular velocity deviation between the determined target pitch angular velocity $\omega_{2p}$ and the pitch angular velocity $\omega_{1p}$ determined in step S511 (described below) (step S507), and performs, for example, PI control on the calculated pitch angular velocity deviation to generate the pitch torque command $\tau_{0p}$ (step S508).

The controller corrects the generated pitch torque command $\tau_{0p}$ with the pitch direction external torque $\tau_{3p}$ estimated in step S513 (described below), and generates the pitch torque command $\tau_{2p}$ (step S509).

The controller A/D-converts a pitch angular velocity output of the pitch gyro sensor 5 and acquires the resulting pitch angular velocity output (step S510). The controller multiples the acquired pitch angular velocity output by a conversion factor to determine the pitch angular velocity $\omega_{1p}$ (step S511).

By using Equation 18, the controller estimates, from the determined pitch angular velocity $\omega_{1p}$ and the pitch torque command $\tau_{2p}$ generated in step S509, a pitch inclination angle by which the main body 3 is inclined from a balanced state in the pitch direction (step S512). On the basis of the estimated pitch inclination angle, the controller estimates a pitch direction external torque produced by inclination from the balanced state in the pitch direction (step S513).

The controller determines whether the pitch torque command $\tau_{2p}$ has been generated in step S509 (step S514).

If the controller determines that the pitch torque command $\tau_{2p}$ has been generated (YES in step S514), the controller multiplies the generated pitch torque command $\tau_{2p}$ by a conversion factor to determine a command voltage (step S515). The controller D/A-converts the determined command voltage and outputs the resulting command voltage to the driver that drives the pitch motor 6 to rotate (step S516). The controller returns the process to step S501 and step S510 and repeats the process described above.

On the other hand, if the controller determines that the pitch torque command $\tau_{2p}$ has not been generated (NO in step S514), since the main body 3 is in a balanced state and no forward/backward movement instruction is received, the controller terminates the process. The process described above is performed when a forward or backward movement instruction is received in the form of a pulse signal of a rotational angle. However, even when a pulse signal of a rotational velocity is received as a forward or backward movement instruction, an inclination angle in the pitch direction can be controlled, through the same process, by determining a deviation in pitch angular velocity.

Referring back to FIG. 1, the walking assist apparatus 1 of the present preferred embodiment preferably includes an auxiliary wheel 8 to enhance stability of the elderly or disabled person (user) during walking. The support unit 7 is connected at one end thereof to the main body 3 so as to be pivotable in the pitch direction. The auxiliary wheel 8 is rotatably supported at the other end of the support unit 7. The walking assist apparatus 1 may include either one auxiliary wheel 8 as illustrated in FIG. 1, or a pair of auxiliary wheels 8 for enhanced stability in the roll direction.

The position of a support point 10 about which the support unit 7 pivots is not particularly limited, as long as it is within the main body 3. That is, the support point 10 may be located anywhere within the main body 3, as long as the main body 3 can be prevented from falling.

An electric motor (second driving unit) 9 that rotates a connection portion of the support unit 7 or the auxiliary wheel 8 may be provided in the connection portion of the support unit 7. In this case, the control board 32 serves as a second control unit. For example, the controller receives designation of a target angle $\theta_{ref}$, in advance, for an angle between the support unit 7 and the main body 3, and controls the operation of the electric motor 9 such that an angle $\theta$ between the support unit 7 and the main body 3 is equal to the target angle $\theta_{ref}$. The angle $\theta$ between the support unit 7 and the main body 3 is calculated from a pulse signal output by a support unit angle encoder 91 included in the electric motor 9.

Figure 6:
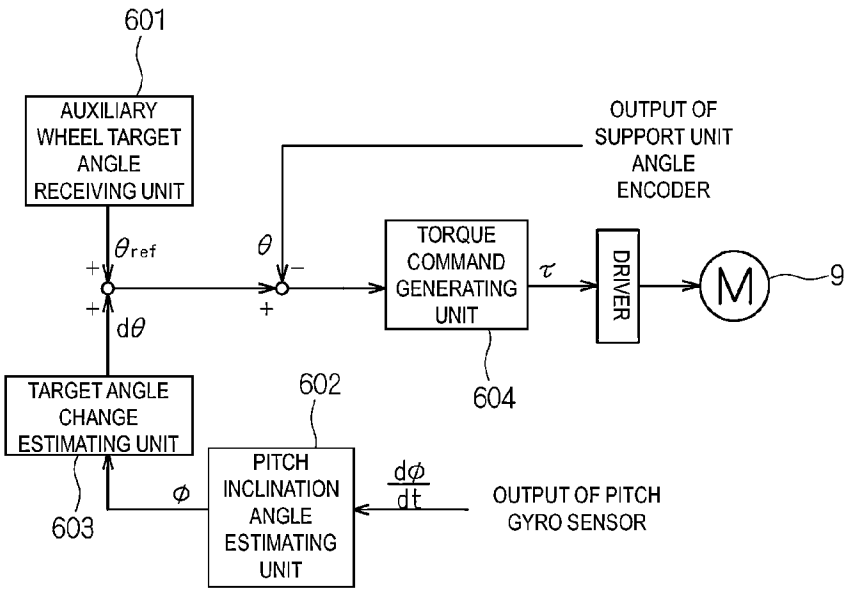
FIG. 6 is a control block diagram illustrating a control operation that controls an operation of a support unit that supports an auxiliary wheel of the walking assist apparatus according to a preferred embodiment of the present invention.

FIG. 6 is a control block diagram illustrating a control operation to control an operation of the support unit 7 that supports the auxiliary wheel 8 of the walking assist apparatus 1 according to a preferred embodiment of the present invention. As illustrated in FIG. 6, an auxiliary wheel target angle receiving unit 601 receives designation of the target angle $\theta_{ref}$ for the angle $\theta$ between the main body 3 and the support unit 7 that supports the auxiliary wheel 8.

A pitch inclination angle estimating unit 602 integrates a pitch angular velocity $d\phi/dt$ output by the pitch gyro sensor 5 to estimate a pitch inclination angle $\phi$. On the basis of the estimated pitch inclination angle $\phi$, a target angle change estimating unit 603 estimates a target angle change $d\theta$ for the support unit 7 that supports the auxiliary wheel 8. Specifically, the target angle change estimating unit 603 calculates the angle change $d\theta$ of the target angle $\theta_{ref}$ using Equation 22:

Numerical Expression 14

$$d\theta = \theta_{ref}\left[\frac{\varphi}{\varphi_o} - 1\right] \qquad \text{Equation 22}$$

In Equation 22, $\phi_0$ denotes a balanced angle of the pitch inclination angle, $\phi$ denotes the pitch inclination angle estimated by the pitch inclination angle estimating unit 602, and $\theta_{ref}$ denotes the designated target angle for the support unit 7 received by the auxiliary wheel target angle receiving unit 601.

The angle $\theta$ between the support unit 7 and the main body 3 is calculated as a sum of the target angle $\theta_{ref}$ and the target angle change $d\theta$. A torque command generating unit 604 performs, for example, PID control on a deviation between the angle $\theta$ calculated from the output (pulse signal) of the support unit angle encoder 91 and the calculated target angle ($\theta_{ref}$+$d\theta$) to generate a torque command $\tau$. The generated torque command $\tau$ is multiplied by a conversion factor to determine a command voltage. The DA converter or the like outputs the command voltage to the driver, which controls the operation of the electric motor 9.

Figure 7B:
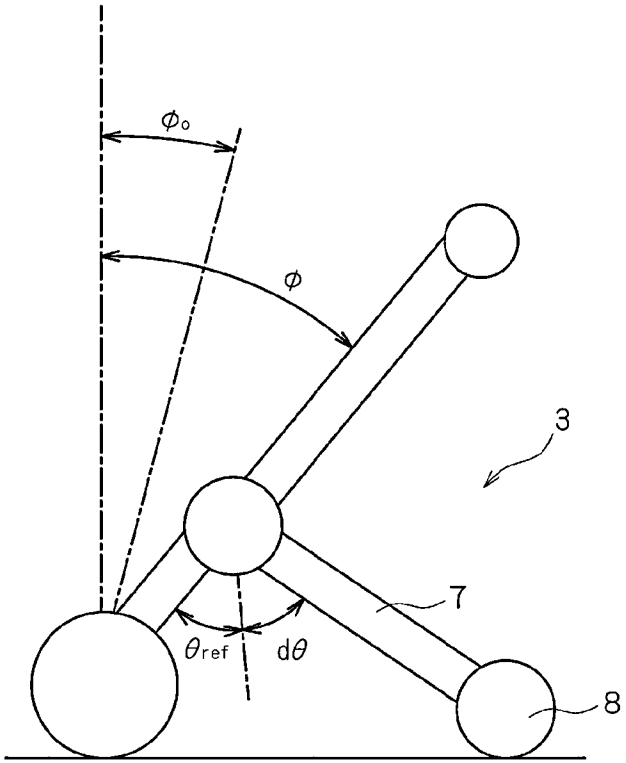
FIGS. 7A and 7B schematically illustrate how an operation of the auxiliary wheel is controlled by an electric motor of the walking assist apparatus according to a preferred embodiment of the present invention.
Figure 7A:
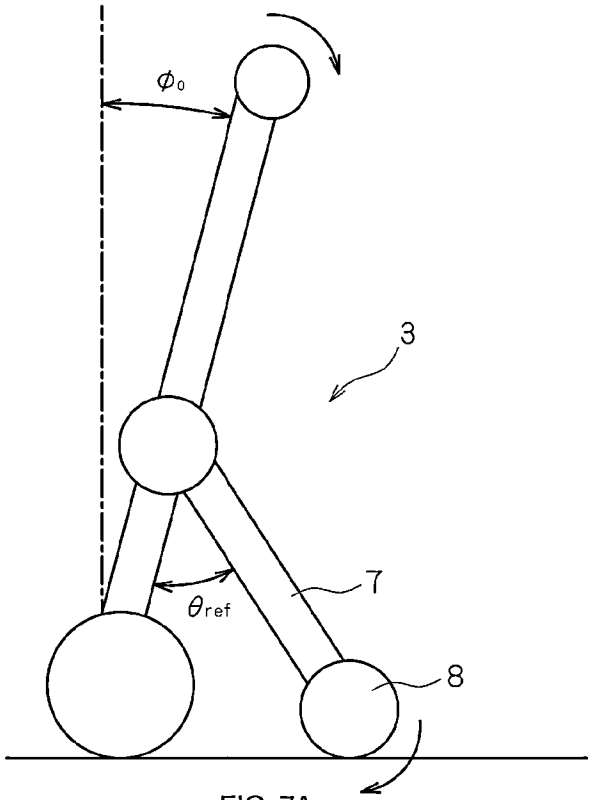

FIGS. 7A and 7B schematically illustrate how an operation of the auxiliary wheel 8 is controlled by the electric motor 9 of the walking assist apparatus 1 according to a preferred embodiment of the present invention. FIG. 7A illustrates a state where no external force is applied to the walking assist apparatus 1 (i.e., the walking assist apparatus 1 is at a standstill). FIG. 7B illustrates a state where an external force is applied to the walking assist apparatus 1.

When no external force is applied to the walking assist apparatus 1 as illustrated in FIG. 7A, the process illustrated in FIG. 5 controls the operation of the pitch motor 6 such that the pitch inclination angle $\phi$ of the main body 3 converges to the balanced angle $\phi_0$. If the main body 3 is inclined by an angle greater than the balanced angle $\phi_0$, the operation of the pitch motor 6 causes the main body 3 to change the pitch inclination angle $\phi$ back to the balanced angle $\phi_0$, so that the main body 3 repeats the swinging motion about the balanced angle $\phi_0$. Additionally, by controlling the operation of the electric motor 9 such that the angle $\theta$ of the support unit 7 that supports the auxiliary wheel 8 is equal to the target angle $\theta_{ref}$, it is possible to reduce the swinging motion of the main body 3 caused by the pitch motor 6. The operation of the electric motor 9 is controlled such that, by changing the target angle for the support unit 7 that supports the auxiliary wheel 8 in accordance with a change in inclination angle of the main body 3 in the pitch direction, the ratio of force with which the support unit 7 supports the main body 3 is kept constant. This prevents the reactive force of the support unit 7 against the main body 3 from interfering with the control of operation of the pitch motor 6.

If a large external force is suddenly applied to the walking assist apparatus 1 as illustrated in FIG. 7B, the pitch inclination angle $\phi$ of the main body 3 changes significantly. The controller of the control board 32 determines whether the pitch inclination angle $\phi$ exceeds a predetermined threshold, such as 25 degrees, for example. A control equation has a large time constant so that, if the controller determines that the pitch inclination angle $\phi$ exceeds the predetermined threshold, the operation of the electric motor 9 is delayed for a long time (delay control). This can delay the response to the applied external force and slow the operation. Therefore, even if a large external force is suddenly applied to the walking assist apparatus 1 when, for example, the user suddenly almost falls, the inclination of the main body 3 can be slowly corrected. Thus, since the behavior of the main body 3 does not change significantly, it is possible to reduce the risk of falling of the elderly or disabled person (user).

Possible patterns of falling of the user include "falling in the forward direction" and "falling in the backward direction" during walking. Either "falling in the forward direction" or "falling in the backward direction" can be prevented depending on the relative position of the user, the auxiliary wheel 8, and the pair of wheels 2 of the main body 3.

Figure 8A:
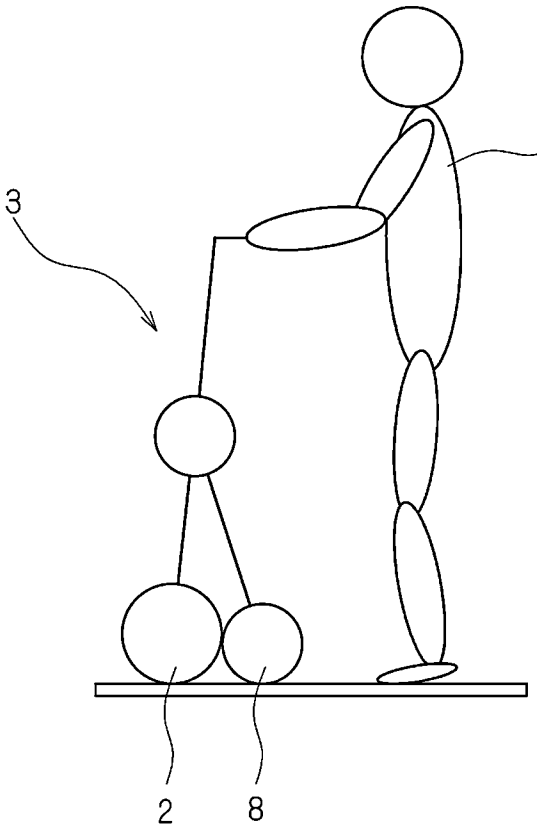
FIGS. 8A and 8B schematically illustrate the cases in which the auxiliary wheel is located between a user and a pair of wheels of a main body.
Figure 8B:
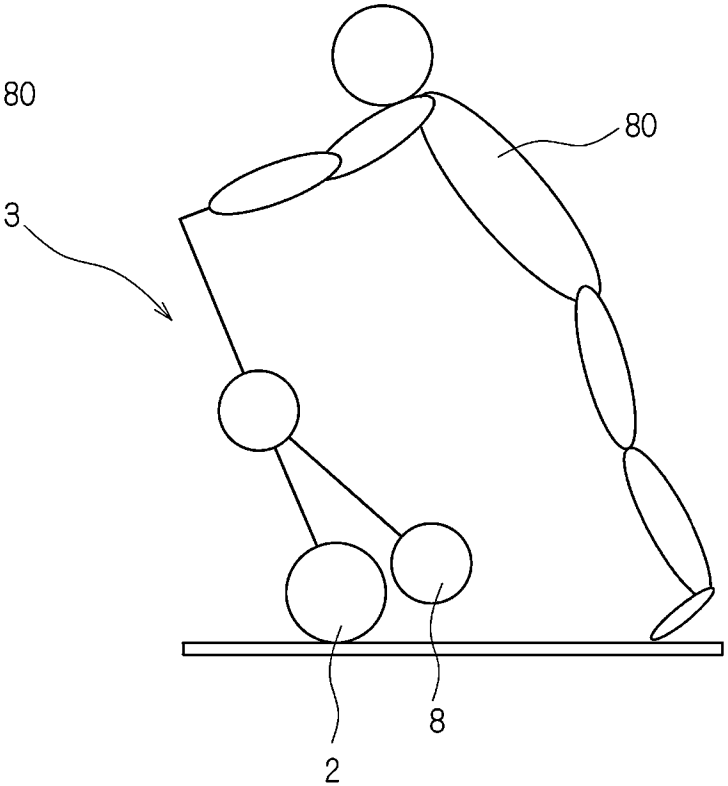

FIGS. 8A and 8B schematically illustrate the cases in which the auxiliary wheel 8 is located between the user and the pair of wheels 2 of the main body 3. As illustrated in FIG. 8A, when the auxiliary wheel 8 is located between a user 80 and the pair of wheels 2 of the main body 3, "falling in the backward direction" during walking can be easily prevented by the auxiliary wheel 8. However, as illustrated in FIG. 8B, "falling in the forward direction" may not be prevented, due to floating of the auxiliary wheel 8 which is supposed to prevent falling.

Figure 9B:
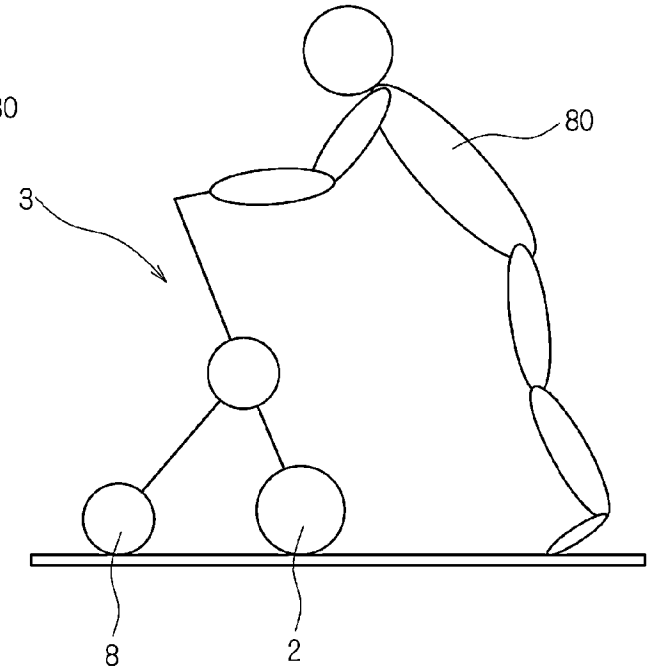
FIGS. 9A and 9B schematically illustrate the cases in which the pair of wheels of the main body is located between the user and the auxiliary wheel.
Figure 9A:
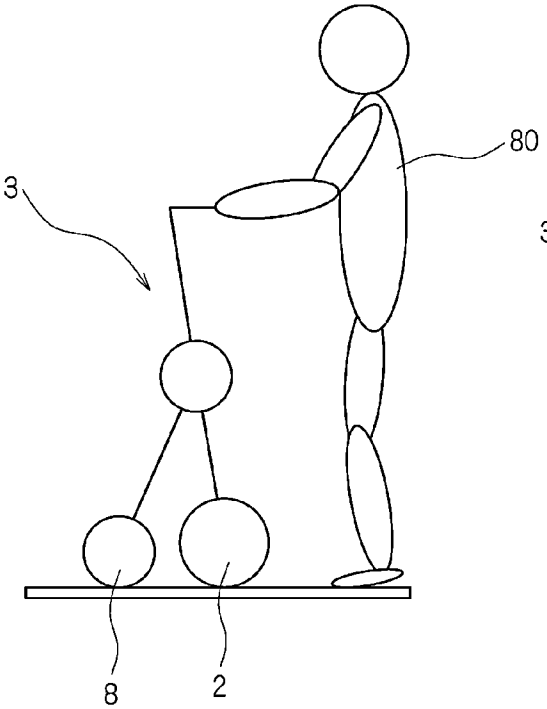

FIGS. 9A and 9B schematically illustrate the cases in which the pair of wheels 2 of the main body 3 is located between the user 80 and the auxiliary wheel 8. As illustrated in FIG. 9A, when the pair of wheels 2 of the main body 3 is located between the user 80 and the auxiliary wheel 8, "falling in the forward direction" during walking can be reliably prevented by the auxiliary wheel 8. That is, either "falling in the forward direction" or "falling in the backward direction" during walking can be prevented by selecting a relative position of the user 80, the auxiliary wheel 8, and the pair of wheels 2 of the main body 3.

A method for changing the relative position of the user 80, the auxiliary wheel 8, and the pair of wheels 2 of the main body 3 is not particularly limited, but, for example, the grip 4 may be turnably provided at one end of the main body 3. FIGS. 10A-10D schematically illustrate how the grip 4 of the walking assist apparatus 1 according to a preferred embodiment of the present invention is attached to the main body 3.

Figure 10A:
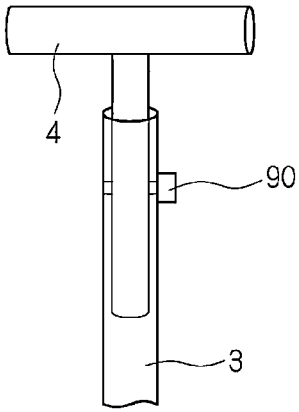
FIGS. 10A-10D schematically illustrate how a grip of the walking assist apparatus according to a preferred embodiment of the present invention is attached to the main body.
Figure 10B:
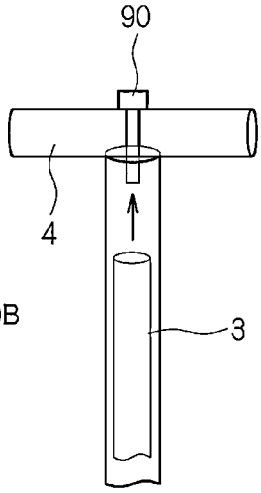

For example, as illustrated in FIG. 10A and FIG. 10B, the grip 4 separate from the main body 3 may be secured with a screw or pin 90 to the main body 3. Loosening the screw or pin 90 allows the grip 4 to turn in the yaw direction of the main body 3. When the grip 4 is turned 180 degrees, the relative position of the user 80, the auxiliary wheel 8, and the pair of wheels 2 of the main body 3 is changed.

Figure 10C:
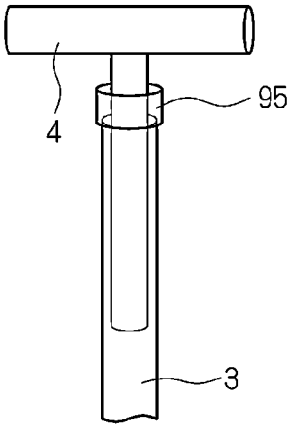
Figure 10D:
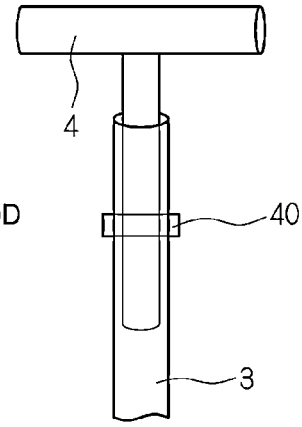

As illustrated in FIG. 10C, the grip 4 separate from the main body 3 may be turned and secured with a nut 95. As illustrated in FIG. 10D, a support portion of the grip 4 separate from the main body 3 may be provided with a protrusion 40 that can be pushed in with a finger. In this case, the main body 3 may be provided with a plurality of holes, at the same height, into which the protrusion 40 is inserted when the support portion of the grip 4 is inserted into the main body 3. The grip 4 can be locked at the holes by inserting the support portion of the grip 4 into the main body 3 while pushing down the protrusion 40. For example, to change the orientation of the grip 4 by 180 degrees, the grip 4 may be locked at the holes after being turned by 180 degrees while the protrusion 40 is being pushed down.

The height of the grip 4 illustrated in FIGS. 10A-10D can be easily adjusted. For example, in the cases of FIGS. 10A and 10C, the height of the grip 4 can be easily changed by adjusting the height at which the grip 4 is secured to the main body 3. In the cases of FIG. 10D, the height of the grip 4 can be easily changed by providing a plurality of holes at different heights. In the case of FIG. 10B, the same effect can be expected when the support portion of the grip 4 is configured to be able to change its height, for example, when the support portion of the grip 4 is configured to be slidable.

Instead of the electric motor 9 that turns the support unit 7, the one or pair of auxiliary wheels 8 may be provided with a rotary motor to regulate the rotation of the one or pair of auxiliary wheels 8. In this case, the controller determines whether the angle $\theta$ exceeds a predetermined threshold, such as an inclination angle of 25 degrees, for example. If the controller determines that the angle $\theta$ exceeds the predetermined threshold, it is possible to regulate the rotation of the rotary motor and control the operation of the rotary motor so as not to allow rotation of the one or pair of auxiliary wheels 8. This allows the one or pair of auxiliary wheels 8 to serve as a brake, and to support the user 80 like a stick does.

Figure 11:
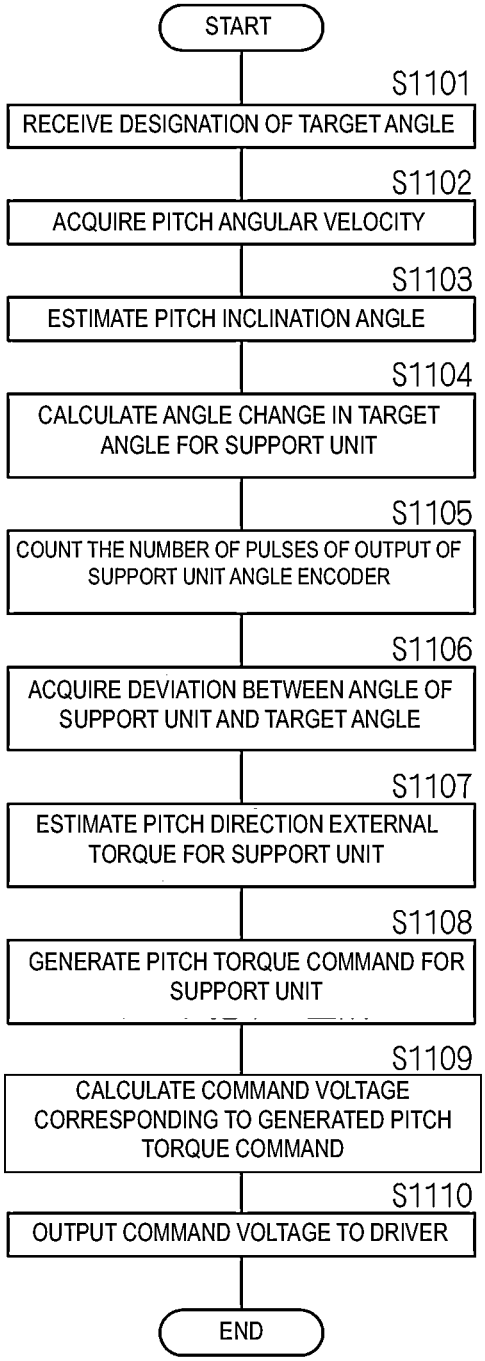
FIG. 11 is a flowchart illustrating a process that controls, in the pitch direction, an angle of the support unit that supports the auxiliary wheel, the process being performed by the controller of the control board in the walking assist apparatus.

FIG. 11 is a flowchart illustrating a process that control, in the pitch direction, an angle of the support unit 7 that supports the auxiliary wheel 8, the process being performed by the controller of the control board 32 in the walking assist apparatus 1.

As illustrated in FIG. 11, the controller of the control board 32 receives designation of the target angle $\theta_{ref}$ for an angle between the main body 3 and the support unit 7 that supports the auxiliary wheel 8 (step S1101). The controller A/D-converts a pitch angular velocity output by the pitch gyro sensor 5 and acquires the resulting pitch angular velocity (step S1102). The controller integrates the acquired pitch angular velocity to estimate the pitch inclination angle $\phi$ (step S1103), and calculates the angle change $d\theta$ in the target angle $\theta_{ref}$ for the support unit 7 using Equation 22 (step S1104).

The controller counts the number of pulses of the output (pulse signal) of the support unit angle encoder 91 (step S1105), and acquires a deviation between the angle $\theta$ of the support unit 7 calculated from the output (pulse signal) of the support unit angle encoder 91 and the target angle ($\theta_{ref}$+d$\theta$) for the support unit 7 (step S1106). The controller uses the deviation between the angle $\theta$ of the support unit 7 and the target angle ($\theta_{ref}$+d$\theta$) for the support unit 7 to estimate a pitch direction external torque that causes the support unit 7 to pivot in the pitch direction (step S1107).

On the basis of the estimated pitch direction external torque, the controller generates a pitch torque command (step S1108), and multiples the generated pitch torque command by a conversion factor to determine a command voltage (step S1109). The controller D/A-converts the determined command voltage and outputs the resulting command voltage to the driver that drives the electric motor 9 to rotate (step S1110). The controller repeats the process from step S1101 to step S1110.

In the present preferred embodiment, by controlling the operation of the pitch motor 6 such that the angular change of the main body 3 is zero, the inclination angle of the main body 3 in the pitch direction can be controlled to converge to a balanced angle at which the main body 3 can be kept balanced and does not fall over. Thus, without requiring the elderly or disabled person (user 80) to particularly consciously apply an external force, the walking assist apparatus 1 can stably assist the elderly or disabled person (user 80) in walking. Even when the elderly or disabled person (user 80) leans his or her body weight on the grip 4, the auxiliary wheel 8 can reduce inclination of the main body 3, so that the walking assist apparatus 1 can safely assist the elderly or disabled person (user 80) in walking. Even if a large external force is suddenly applied and the user 80 almost falls, the behavior of the main body 3 does not change significantly. Thus, it is possible to reduce the risk of falling of the elderly or disabled person (user 80).

Given that the walking assist apparatus 1 is used outside in one implementation of various preferred embodiments of the present invention, it is natural to use the battery 33 as a driving source. However, if the battery 33 serving as a driving source always controls the operation of the pitch motor 6 and the electric motor 9, the battery 33 may run out very quickly and may not be able to be used for a long time.

Accordingly, for example, the controller may be configured such that if it determines that the pitch inclination angle $\phi$ does not exceed a predetermined threshold, it does not supply power to the electric motor 9 or the second control unit that controls the operation of the electric motor 9 (i.e., the controller does not control the second control unit (electric motor 9)). This makes it possible to reduce power consumption.

The walking assist apparatus 1 may include a brake mechanism (first restraining mechanism) that restrains pivoting of the support unit 7 and a detector that detects whether there is an input from the user to the grip 4. Then, if it is determined that nothing is input or received from the user to the grip 4 for more than a certain period of time (e.g., 10 seconds), the supply of power to the electric motor 9 or the second control unit that controls the operation of the electric motor 9 may be stopped (i.e., no control of the second control unit (electric motor 9) may be performed) with the brake mechanism activating, so that power consumption can be reduced.

The supply of power to the pitch motor 6 or the first control unit that controls the operation of the pitch motor 6 may be stopped. Since the position of the walking assist apparatus can be maintained by the support unit 7 alone, the amount of power required to control the first driving unit (pitch motor 6) can be reduced.

As a detector arranged to detect whether there is an input from the user to the grip 4, an output signal from the pitch gyro sensor 5 may be used. Alternatively, the grip 4 may be provided with a contact sensor that detects whether the user has touched the grip 4.

It is to be understood that the preferred embodiments described above can be changed without departing from the scope of the present invention. For example, although the pair of wheels 2 described above is preferably provided with one pitch motor 6, each of the wheels may be provided with one pitch motor, for example. Similarly, although the brake mechanism (first restraining mechanism) described above is preferably provided in the connection portion of the support unit 7, the pair of wheels 2 may be provided with another restraining mechanism (second restraining mechanism), or each of the wheels 2 may be provided with one restraining mechanism (second restraining mechanism), for example. Although an angular velocity sensor is preferably used as the pitch gyro sensor 5 described above, an angular acceleration sensor, an inclination sensor, or a combination of these sensors may be used as the pitch gyro sensor 5.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A walking assist apparatus comprising:

a pair of wheels;

one rotatable auxiliary wheel or a pair of rotatable auxiliary wheels;

at least one first driving unit that drives the pair of wheels;

a main body that rotatably supports the pair of wheels;

a grip that is disposed at one end of the main body to be able to be gripped by a user while standing up and walking and to assist the user in standing up and walking;

a sensor unit configured to detect an angular change in an inclination angle of the main body in a pitch direction; and a first control unit configured and programmed to control an operation of the at least one first driving unit based on an output of the sensor unit such that the angular change in the inclination angle of the main body converges to zero; wherein the grip is turnable in a yaw direction of the main body in order to selectively position the one rotatable auxiliary wheel or pair of rotatable auxiliary wheels between the pair of wheels of the main body and the user, or to position the pair of wheels of the main body between the one rotatable auxiliary wheel or pair of rotatable auxiliary wheels and the user.

2. The walking assist apparatus according to claim 1, wherein the sensor unit includes at least one of an angular velocity sensor, an inclination sensor, and an angular acceleration sensor.

3. The walking assist apparatus according to claim 1, wherein the main body includes a support unit connected at a first end thereof to the main body so as to be pivotable in the pitch direction; and a second end of the support unit is provided with the one rotatable auxiliary wheel or a pair of rotatable auxiliary wheels.

4. The walking assist apparatus according to claim 3, further comprising:

a second driving unit configured to rotate a connection portion of the support unit or the one rotatable auxiliary wheel or pair of auxiliary wheels; and a second control unit configured and programmed to control the second driving unit; wherein the second control unit receives designation of a target angle for an angle between the support unit and the main body; and the second control unit is programmed to control an operation of the second driving unit based on an output of the sensor unit such that the angle between the support unit and the main body is equal to the target angle.

5. The walking assist apparatus according to claim 4, wherein the second driving unit is provided in the connection portion of the support unit; and the second control unit is programmed to determine whether a change in output of the sensor unit exceeds a predetermined threshold, and, if it is determined that the change in output of the sensor unit exceeds the predetermined threshold, the second control unit is programmed to perform delay control to reduce a change in angle between the support unit and the main body.

6. The walking assist apparatus according to claim 4, wherein the second driving unit is provided in the connection portion of the support unit; and the second control unit is programmed to determine whether a change in output of the sensor unit or a change in output of an encoder of the second driving unit exceeds a predetermined threshold, and, if it is determined that the change in output of the sensor unit or the change in output of the encoder of the second driving unit does not exceed the predetermined threshold, the second control unit is programmed not to control the second driving unit.

7. The walking assist apparatus according to claim 3, further comprising:

a first restraining mechanism configured to restrain pivoting of the support unit; and a detector arranged to detect whether there is an input from the user to the grip; wherein if the detector detects that there is no input to the grip, the first restraining mechanism stops pivoting of the support unit.

8. The walking assist apparatus according to claim 7, wherein if the detector determines that there is no change in output of the sensor unit for more than a certain period of time, the detector detects that there is no input to the grip.

9. The walking assist apparatus according to claim 7, wherein the detector includes a contact sensor provided in the grip.

10. The walking assist apparatus according to claim 7, wherein when the first restraining mechanism stops pivoting of the support unit, the first control unit is programmed not to control the first driving unit.

11. The walking assist apparatus according to claim 7, further comprising a second restraining mechanism configured to stop rotation of at least one wheel of the pair of wheels when the first restraining mechanism stops pivoting of the support unit.

12. The walking assist apparatus according to claim 1, wherein the sensor unit includes a pitch gyro sensor, the at least one first driving unit includes a pitch motor, and the main body includes a pitch encoder.

13. The walking assist apparatus according to claim 12, wherein the pitch gyro sensor is arranged to detect a pitch angular velocity in a right and left direction or substantially in the right and left direction.

14. The walking assist apparatus according to claim 1, wherein the main body includes a frame that connects the pair of wheels to the main body.

15. The walking assist apparatus according to claim 1, wherein the first control unit includes a control board including a driver arranged to drive a pitch motor, an analog-to-digital converter, a digital-to-analog converter, a counter and a controller.

16. The walking assist apparatus according to claim 1, wherein the first control unit is programmed to use a reaction torque of the pair of wheels to control the angular change of the inclination angle of the main body to converge to zero.

* * * * *